US007422575B2

(12) United States Patent
Dallabetta

(10) Patent No.: US 7,422,575 B2
(45) Date of Patent: Sep. 9, 2008

(54) LOTION APPLICATOR

(76) Inventor: Dana Dallabetta, 160 W. 72st St., New York, NY (US) 10023

( * ) Notice: Subject to any disclaimer, the term of this patent is extended or adjusted under 35 U.S.C. 154(b) by 28 days.

(21) Appl. No.: 11/461,485

(22) Filed: Aug. 1, 2006

(65) Prior Publication Data

US 2008/0033375 A1 Feb. 7, 2008

(51) Int. Cl.

| | |
|---|---|
| ***A61M 35/00*** | (2006.01) |
| *A46B 5/02* | (2006.01) |
| *B05C 17/02* | (2006.01) |
| *B43M 11/02* | (2006.01) |

(52) U.S. Cl. ..... 604/289; 604/140; 604/501; 401/6; 401/208; 401/219; 401/220

(58) Field of Classification Search ..... 604/289, 604/20, 96.01, 140, 501; 401/7, 153, 131, 401/6, 208, 220, 219

See application file for complete search history.

(56) References Cited

U.S. PATENT DOCUMENTS

| | | | | |
|---|---|---|---|---|
| 3,308,579 | A * | 3/1967 | Thams | 49/192 |
| 5,573,342 | A * | 11/1996 | Patalano | 401/175 |
| 6,039,705 | A * | 3/2000 | Wu | 601/99 |
| 6,302,122 | B1 * | 10/2001 | Parker et al. | 132/333 |
| 6,415,470 | B1 * | 7/2002 | Ramrattan | 15/144.4 |
| 6,550,634 | B1 * | 4/2003 | Alegre De Miquel et al. | 221/48 |
| 7,041,089 | B2 * | 5/2006 | Laughlin | 604/289 |
| 2004/0147884 | A1 * | 7/2004 | Szurko | 604/289 |

* cited by examiner

*Primary Examiner*—Leslie Deak
*Assistant Examiner*—Ilya Y Treyger
(74) *Attorney, Agent, or Firm*—Marguerite Del Valle

(57) ABSTRACT

A lotion applicator which provides total, even coverage of the back of the user and does not require manual dexterity or stretching, consisting of a door mount, rotor, rotor guide, and one or more pads. The door mount is attached to a vertical surface, preferably a door, but the device can also be mounted to a wall. The user stands with her back against the device and, raising her arms to about shoulder level, grabs a handle attached to the rotor guide and pushes up, thus lifting the rotor guide. The rotor travels with the guide, whereupon one or more pads, which are impregnated with lotion and attached to the rotor in an off-center position, spin along the back of the user, spreading lotion.

2 Claims, 3 Drawing Sheets

LOTION APPLICATOR

This invention is a device which can be used to apply lotion, sunscreen, moisturizer, or the like evenly and completely to the user's own back without the assistance of a second person.

It is well-known and appreciated that it is difficult to apply a liquid, such as lotion, sunscreen, or moisturizer to one's own back. The normal person does not have arms and joints that enable a reach to the middle of the back to apply lotion, sunscreen or moisturizer in an effective, complete, and even fashion. Instead, the user has to reach over her shoulder and around her sides in an often unsuccessful stretching effort to apply the lotion to her back. Consequently, portions of the middle of the back may not receive any lotion at all. Furthermore, the standard process of smoothing lotion on large expanses of skin can result in uneven application, which would be especially problematic when the uneveness is noticeable, as in the situation when the lotion applied is a sunless tanning lotion.

The present invention overcomes these problems and provides an apparatus which allows the user to easily and efficiently apply lotion to her back.

BACKGROUND OF THE INVENTION

There have been numerous attempts to provide a device to apply lotion to the back, see e.g., U.S. Pat. Nos. 6,017,162; 5,983,436; 5,823,206; 5,564,851; and 4,906,118. These devices are basically extensions of the hand such as a strap, wand, or handle, which enables the user to reach places where the hand falls shorts. While these devices provide some measure of extra coverage, however, they are still lacking in that their effectiveness is still dependent on the manual dexterity of the user to position the device in all the correct areas. Even when these devices are used correctly, the results may nonetheless be less than adequate.

BRIEF SUMMARY OF THE INVENTION

The lotion applicator of the present invention is designed to provide total, even coverage of the back of the user and does not require manual dexterity or stretching. The inventive device consists of a door mount, a rotor, a rotor guide, and one or more pads. The door mount is attached to a vertical surface, preferably a door, but the device can also be mounted to a wall. The user stands with her back against the device and, raising her arms to about shoulder level, grabs a handle attached to the rotor guide and pushes up, thus lifting the rotor guide. The rotor travels with the guide, whereupon one or more pads, which are impregnated with lotion and attached to the rotor in an off-center position, spin along the back of the user, spreading lotion. The guide may be raised and lowered any number of times until the entire back area has been covered with lotion. By virtue of the systematic rotary motion of the applicator pad, lotion is applied evenly and completely and without strain on the muscles or joints of the user.

DETAILED DESCRIPTION OF THE INVENTION

Figure 1:
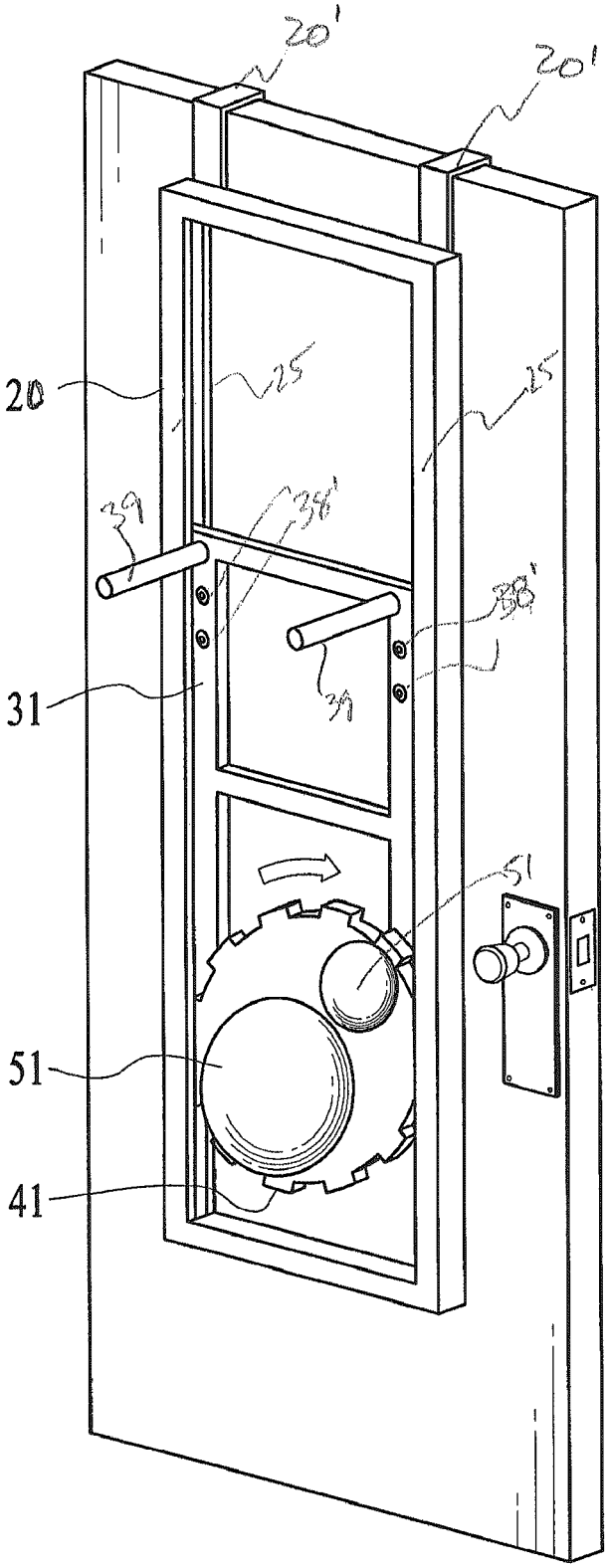
FIG. 1 is a front, right side perspective view of the device.

FIG. 1 illustrates one of the preferred embodiments of the constructed device of the present invention. It consists of a door mount 20, a rotor guide 31, a rotor 41, and at least one pad 51.

Figure 2:
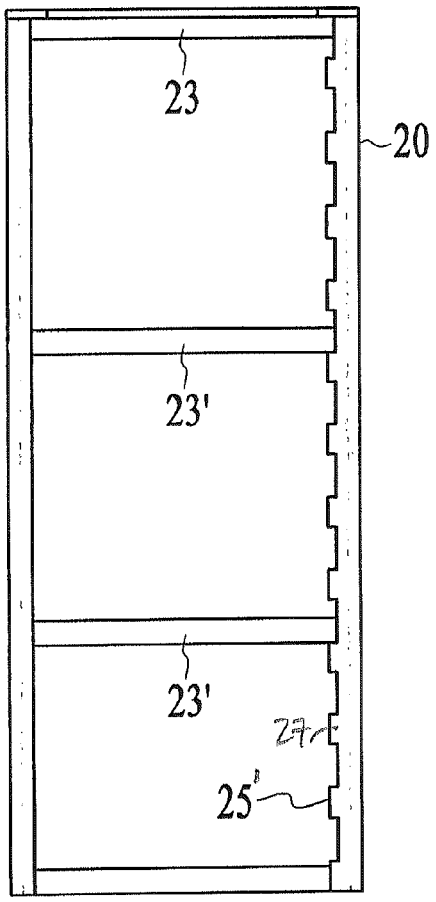
FIG. 2 is a sectional view taken along line 2-2 in FIG. 2A.
Figure 2A:
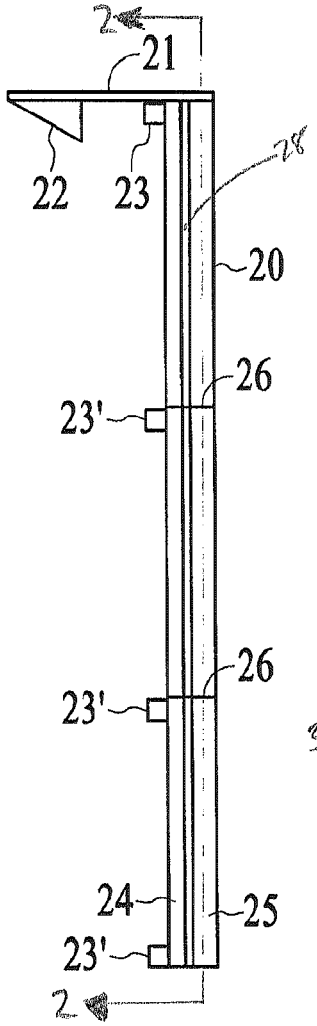
FIG. 2A is a side elevational view of the door mount.

As shown in FIG. 2A, door mount 20 is a frame that may be hung on a door by placing ledge 21 over the top of an opened door (not shown) such that the door fits between block 22 and spacer bar 23. Alternatively, brackets 21', as shown in FIG. 1, may be fitted to the door mount 20 so as to provide means to hang the device on a door. If the device is to be wall-mounted, suitable fasteners, such as screws or nails through spacer bars 23, 23' may be employed. Additional spacer bars 23' are placed along the length of door mount 20 such as to maintain it in a vertical position and to provide structural integrity to the frame as well as to provide support against the door. Descending from the top of the frame of door mount 20 are track guides 24. Overlaying the track guides 24 is outer framing 25, as shown in FIGS. 1 and 2A. Between the track guides 24 and the outer framing 25 is at least one inlaid crenellated tooth guide 25', as shown in FIG. 2, which is attached to outer framing 25. A channel 28 is maintained between track guides 24 and tooth guide 25'. The length and separation of the teeth in the tooth guide 25' are functions of the measure of the teeth 42 of rotor 41. Each tooth 27 in the tooth guide 25' is more than ½" shorter than the corresponding valley 44 in the rotor 41. Optional foldover latches 26 may be placed along the length of the track guide and tooth guide portions so as to enhance portability and storage of the device. Preferably, door mount 21 is between 5 and 6 feet long.

Figure 3:
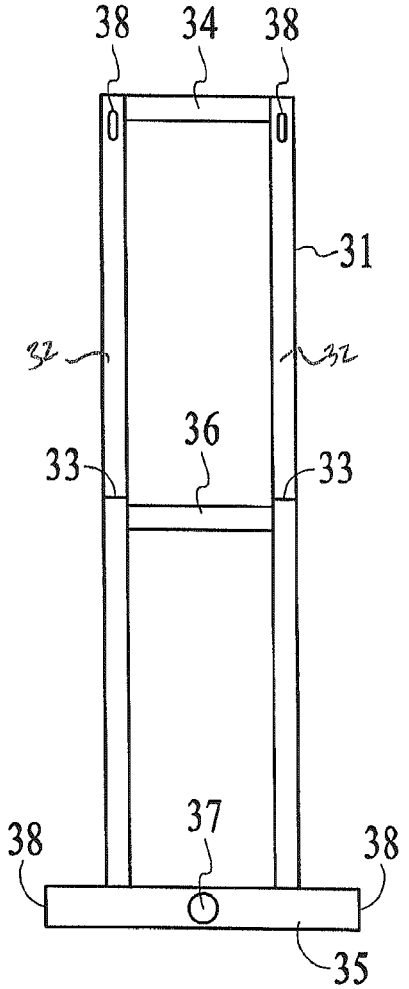
FIG. 3 is a front elevational view of the rotor guide.

The rotor guide 31 is shown in FIG. 3 and consists of two side bars 32 which may be hinged by inlaid foldover latches 33. Side bars 32 are each connected to a top bar 34 and a rotor bar 35. A mid-bar 36 is connected to the mid-points of each side bar 32 to maintain structural integrity of the rotor guide. The length of rotor guide 31 is preferably approximately one foot shorter than the door mount 21. The thickness of the rotor guide 31 is approximately ⅛" thinner than that of door mount 21. A rotor attachment 37 is placed on the rotor bar 35. Handles 38 are located near the top portion of the side bars 32. The handles may be of any configuration that is easy to hold, such as dowels 39, as shown in FIG. 1, which may be adjustably placed along the length of side bars 32 in appropriately drilled holes 38'. Alternatively, as shown in FIG. 3, depressions 38 can be chiseled or drilled into side bars which can act as finger holes. Rotor guide 31 is placed within frame 20 such that rotor guide 31 may be moved vertically in channel 28 between track guide 24 and tooth guide 25'.

Figure 4:
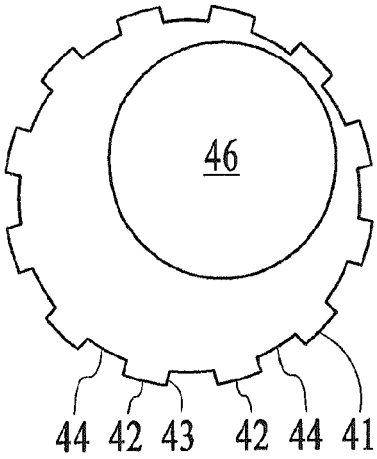
FIG. 4 is a front elevational view of the rotor with a lotion pad attached.
Figure 4A:
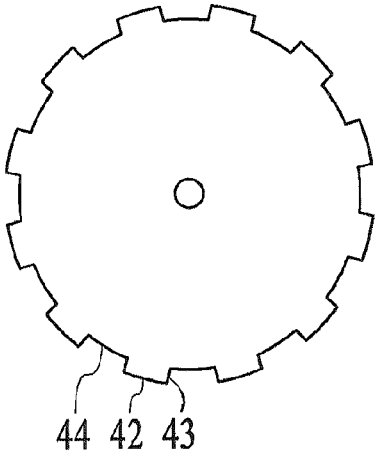
FIG. 4A is a rear elevational view of the rotor.
Figure 4B:
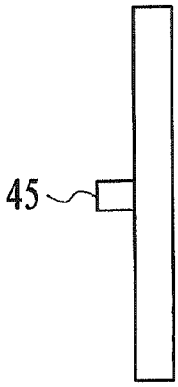
FIG. 4B is a side elevational view of the rotor.

Rotor 41 is shown in FIGS. 4, 4A and 4B. In a preferred embodiment, rotor 41 is a toothed disk with an overall diameter of approximately 14". The teeth 42 have an angled edge 43 and are separated by valleys 44. A central pin extends from the rear of rotor 41 and rotatably fits into rotor attachment 37 on the rotor bar 35. At least one circular velcro facing 46 is attached to rotor 41. In a preferred embodiment, shown in FIG. 4, facing 46 is located in an off-center position on the rotor 41. Facing 46 can, alternatively, be centered on rotor, and can completely cover the non-toothed portion of the rotor. Alternatively, multiple facings 46, of different sizes, may be placed on rotor 41.

Figure 5:
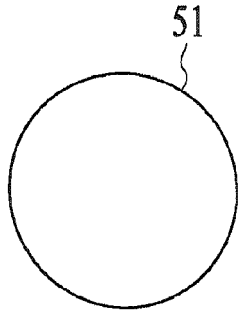
FIG. 5 is a front elevational view of a lotion pad.
Figure 5A:
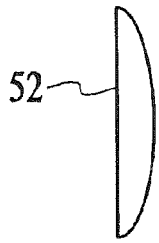
FIG. 5A is a side elevational view of a lotion pad.

As shown in FIGS. 5 and 5A, pad 51 is a circular pad with a velcro backing 52. It is attached to rotor 41 by applying backing 52 to facing 46. Multiple pads 51 may be placed on multiple facings 46 as shown in FIG. 1.

The user of the apparatus applies lotion or some other viscous liquid to pads 51. She stands with her back pressed against pads 51 of the assembled device. Using handles 39 or finger holes 38, she raises the rotor guide 31, thus causing pads 51 to rotate, spreading lotion on her back in a smooth, controlled, and complete manner. The rotor guide may be raised and lowered as many times as needed to ensure complete coverage.

I claim:

1. An apparatus for applying liquid to a person's back comprising:

a. a vertical frame capable of attachment to a vertical surface and having a backing portion facing an outer framing portion, wherein a tooth guide having repeated rectangular indentations is attached to the outer framing portion such that it faces the backing portion directly and is spaced apart from the backing portion so as to maintain a channel between the backing portion and the tooth guide;

b. an inner rectangular frame fit into and capable of being lifted within the channel of the vertical frame, and further comprising a rotary disk comprised of a flat surface and teeth regularly arrayed around the circumference of the disk, where said disk is vertically mounted to a bottom portion of the inner frame such that the flat surface is directed toward the person's back and that when the inner frame is lifted, the disk teeth will sequentially engage the rectangular indentation of the tooth guide so that the disk rotates; and c. an absorbent pad attached to the flat surface of the disk which releases absorbed liquid when pressure is applied thereto.

2. An apparatus according to claim 1 wherein the absorbent pad is located in an off-center position on the flat surface of the disk.

* * * * *